US005531495A

United States Patent [19]

Hohman

[11] Patent Number: 5,531,495

[45] Date of Patent: Jul. 2, 1996

[54] BEVERAGE KEG HANDLING DEVICE

[76] Inventor: Timothy R. Hohman, 74 Griesmere St., Pittsburgh, Pa. 15223

[21] Appl. No.: 490,662

[22] Filed: Jun. 15, 1995

[51] Int. Cl.[6] ..... B65D 25/28; B65G 7/12

[52] U.S. Cl. ..... 294/31.2; 294/165

[58] Field of Search ..... 294/15, 16, 27.1, 294/31.2, 119.2, 149–153, 165; 16/114 R

[56] References Cited

U.S. PATENT DOCUMENTS

| | | | |
|---|---|---|---|
| 140,364 | 7/1873 | Griffing | 294/15 |
| 958,923 | 5/1910 | Jensen | 294/15 |
| 1,337,518 | 4/1920 | Kelley | 294/31.2 |
| 1,406,052 | 2/1922 | Matthiasen | 294/15 X |
| 1,625,255 | 4/1927 | Hudgins | 294/15 |
| 1,965,726 | 7/1934 | Smith | 294/31.2 X |
| 2,165,264 | 7/1939 | Hubbard et al. | 294/31.2 |
| 3,964,126 | 6/1976 | Madsen | 294/31.2 |
| 4,045,069 | 8/1977 | Fife | 294/31.2 |
| 4,116,374 | 9/1978 | Garello | 294/31.2 X |

*Primary Examiner*—Johnny D. Cherry

[57] ABSTRACT

A device for facilitating ease of manual manipulation of a beverage keg. The inventive device includes a pair of handles positionable on diametrically opposed sides of a beverage keg. An alignment strap extends between the handles for circumferential positioning about the keg. A securing strap similarly extends between the handles and can be secured about the keg beneath an annular ridge thereof to permit manual lifting of the keg by the handles.

12 Claims, 3 Drawing Sheets

BEVERAGE KEG HANDLING DEVICE

BACKGROUND OF THE INVENTION

1. Field of the Invention

The present invention relates to handling implements and more particularly pertains to a beverage keg handling device for facilitating ease of manual manipulation of a beverage.

2. Description of the Prior Art

The use of handling implements is known in the prior art. More specifically, handling implements heretofore devised and utilized are known to consist basically of familiar, expected and obvious structural configurations, notwithstanding the myriad of designs encompassed by the crowded prior art which have been developed for the fulfillment of countless objectives and requirements.

Known prior art handling implements include U.S. Pat. No. 3,804,290; U.S. Pat. No. 3,938,768; U.S. Pat. No. 3,952,904; U.S. Pat. No. 5,147,079; and U.S. Pat. No. 5,193,304.

While these devices fulfill their respective, particular objectives and requirements, the aforementioned patents do not disclose a beverage keg handling device for facilitating ease of manual manipulation of a beverage keg which includes a pair of handles positionable on diametrically opposed sides of a beverage keg, an alignment strap extending between the handles for circumferential positioning about the keg, and a securing strap extending between the handles which can be secured about the keg beneath an annular ridge thereof to permit manual lifting of the keg by the handles.

In these respects, the beverage keg handling device according to the present invention substantially departs from the conventional concepts and designs of the prior art, and in so doing provides an apparatus primarily developed for the purpose of facilitating ease of manual manipulation of a beverage keg.

SUMMARY OF THE INVENTION

In view of the foregoing disadvantages inherent in the known types of handling implements now present in the prior art, the present invention provides a new beverage keg handling device construction wherein the same can be utilized for permitting manual grasping and carrying of an associated beverage keg. As such, the general purpose of the present invention, which will be described subsequently in greater detail, is to provide a new beverage keg handling device apparatus and method which has many of the advantages of the handling implements mentioned heretofore and many novel features that result in a beverage keg handling device which is not anticipated, rendered obvious, suggested, or even implied by any of the prior art handling implements, either alone or in any combination thereof.

To attain this, the present invention generally comprises a device for facilitating ease of manual manipulation of a beverage keg. The inventive device includes a pair of handles positionable on diametrically opposed sides of a beverage keg. An alignment strap extends between the handles for circumferential positioning about the keg. A securing strap similarly extends between the handles and can be secured about the keg beneath an annular ridge thereof to permit manual lifting of the keg by the handles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage keg handling device apparatus and method which has manly of the advantages of the handling implements mentioned heretofore and many novel features that result in a beverage keg handling device which is not anticipated, rendered obvious, suggested, or even implied by any of the prior art handling implements, either alone or in any combination thereof.

It is another object of the present invention to provide a new beverage keg handling device which may be easily and efficiently manufactured and marketed.

It is a further object of the present invention to provide a new beverage keg handling device which is of a durable and reliable construction.

An even further object of the present invention is to provide a new beverage keg handling device which is susceptible of a low cost of manufacture with regard to both materials and labor, and which accordingly is then susceptible of low prices of sale to the consuming public, thereby making such beverage keg handling devices economically available to the buying public.

Still yet another object of the present invention is to provide a new beverage keg handling device which provides in the apparatuses and methods of the prior art some of the advantages thereof, while simultaneously overcoming some of the disadvantages normally associated therewith.

Still another object of the present invention is to provide a new beverage keg handling device for facilitating ease of manual manipulation of a beverage keg.

Yet another object of the present invention is to provide a new beverage keg handling device which includes a pair of handles positionable on diametrically opposed sides of a beverage keg, an alignment strap extending between the handles for circumferential positioning about the keg, and a securing strap extending between the handles which can be secured about the keg beneath an annular ridge thereof to permit manual lifting of the keg by the handles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
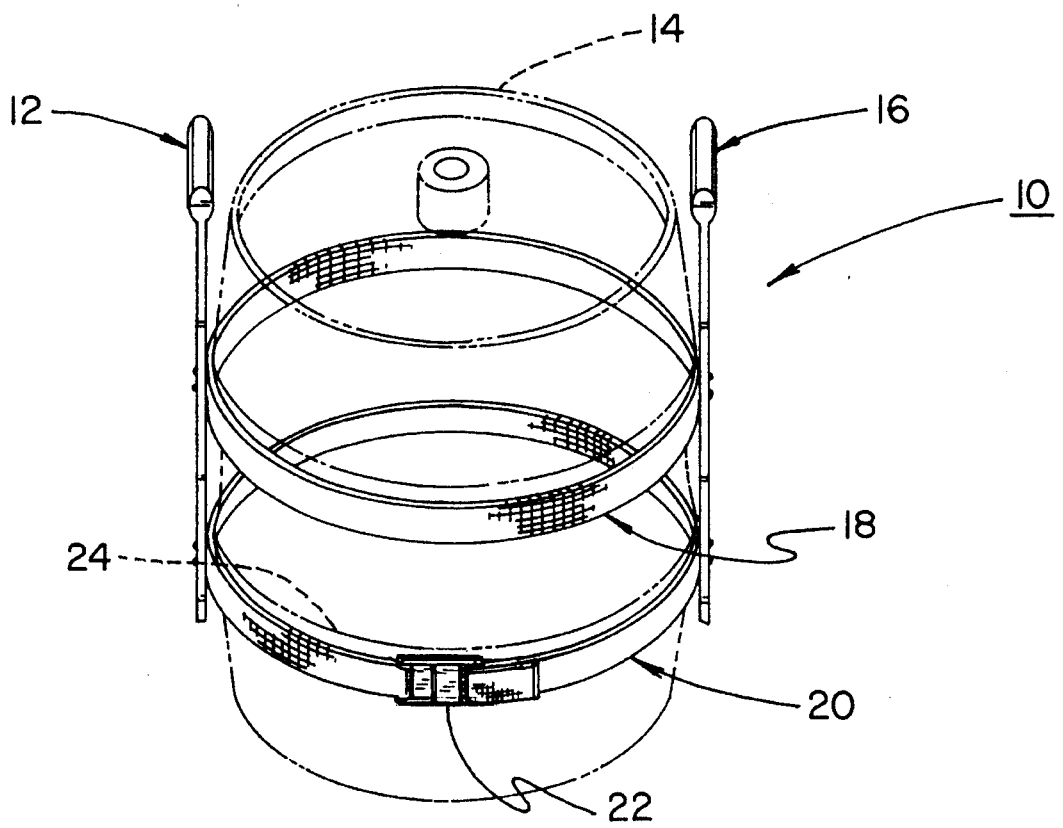
FIG. 1 is an isometric illustration of a beverage keg handling device according to the present invention in use.
Figure 2:
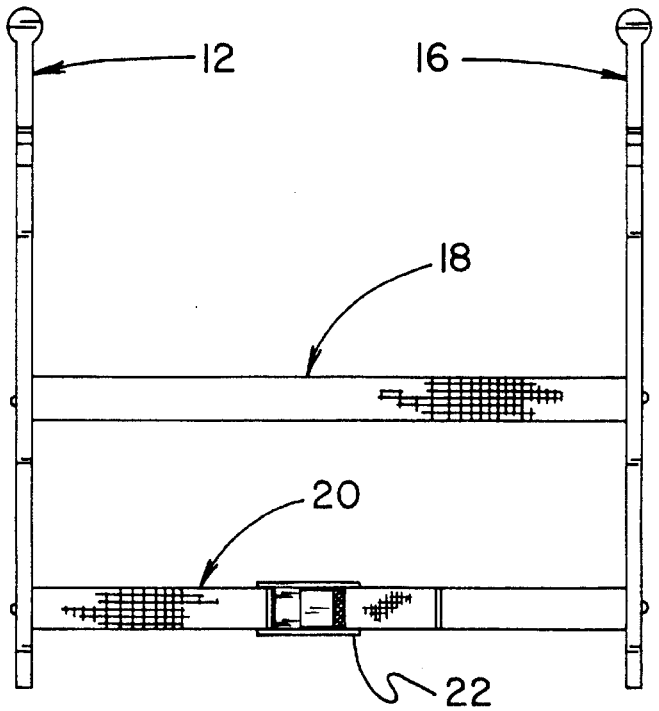
FIG. 2 is a front elevation view of the invention, per se.

With reference now to the drawings, and in particular to FIGS. 1–7 thereof, a new beverage keg handling device embodying the principles and concepts of the present invention and generally designated by the reference numeral 10 will be described.

More specifically, it will be noted that the beverage keg handling device 10 comprises a first handle means 12 positionable vertically along a side wall of a beverage keg 14 for being grasped and manipulated by an individual during use of the device 10. A second handle means 16 positionable along a diametrically opposed portion of the side wall of the beverage keg 14 relative to the first handle means 12 similarly operates for being grasped and manipulated by an individual. An alignment strap 18 of annular configuration extends between the handle means 12 and 16 for circumferential positioning about the beverage keg 14. A securing strap 20 of open annular configuration includes a buckle 22 permitting the securing strap to be secured about the beverage keg 14 beneath an annular ridge 24 of the beverage keg 14. By this structure, one or more individuals can grasp the handle means 12 and 16 to facilitate manual manipulation of the beverage keg 14 when the device 10 is coupled thereto as shown in FIG. 1 of the drawings.

Referring now to FIGS. 2 through 5 wherein the present invention 10 is illustrated in detail, it can be shown that the handle means 12 and 16 are substantially similar in design and configuration and each comprises an elongated member 26 which can be vertically positioned along the side wall of the beverage keg 14 as shown in FIG. 1 of the drawings. The elongated member 26 is dimensioned so as to extend above an upper surface of the beverage keg 14 and includes spaced handle projections 28 extending therefrom which are integrally or otherwise fixedly secured to a cylindrical handle tube 30 extending therebetween. By this structure, an individual is permitted to extend digits of a human hand between the spaced handle projections 28 and about the cylindrical handle tube 30 so as to facilitate manual manipulation of the handle means 12 or 16 during lifting of an associated beverage keg 14.

Figure 3:
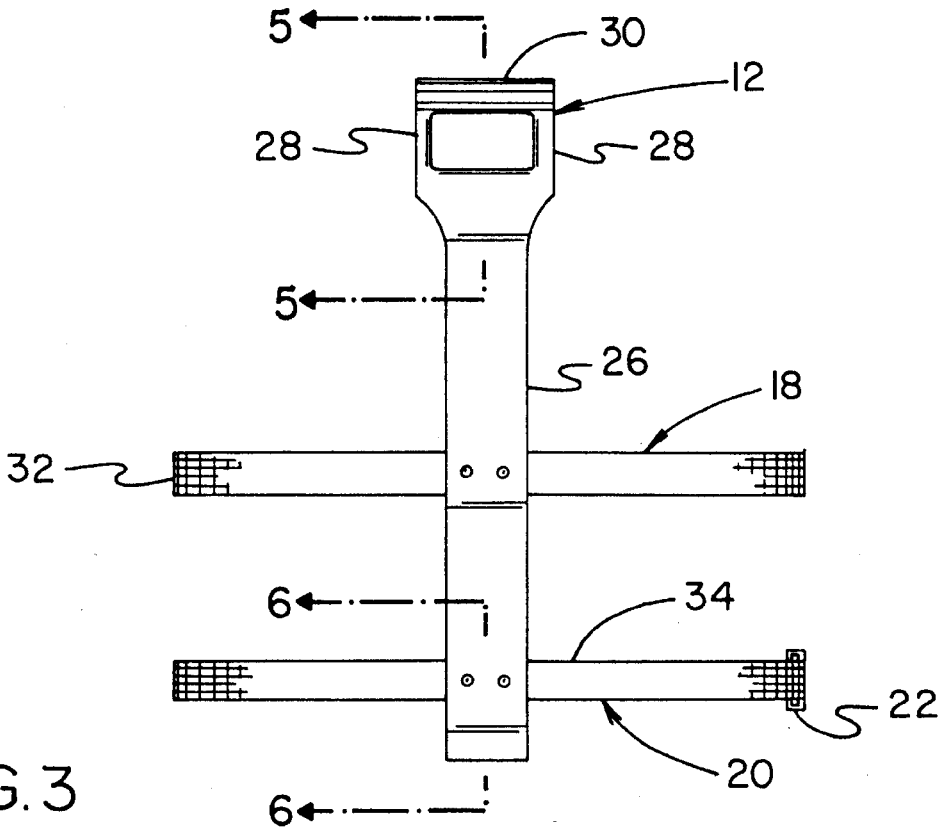
FIG. 3 is a side elevation view thereof.
Figure 4:
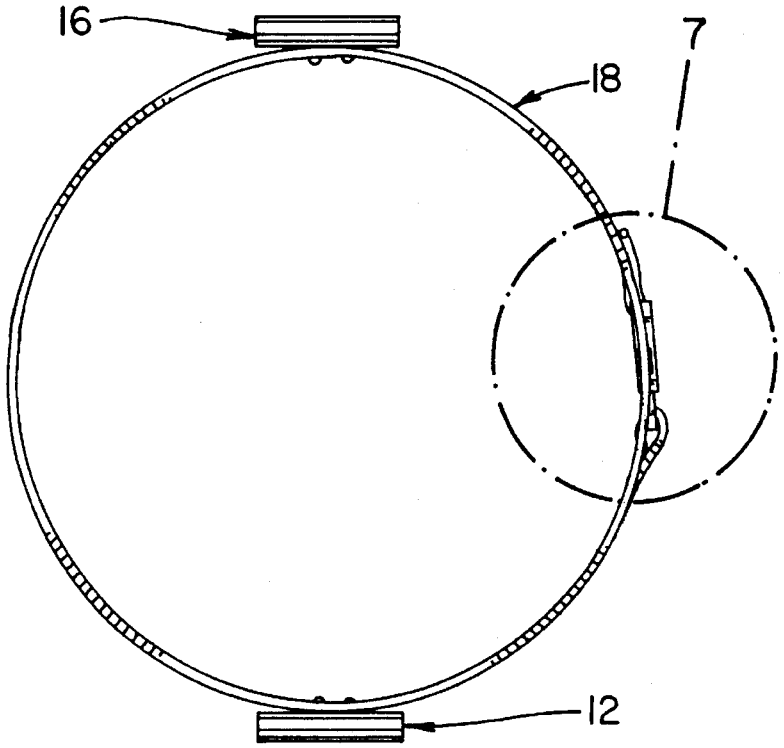
FIG. 4 is a top plan view of the invention.
Figure 5:
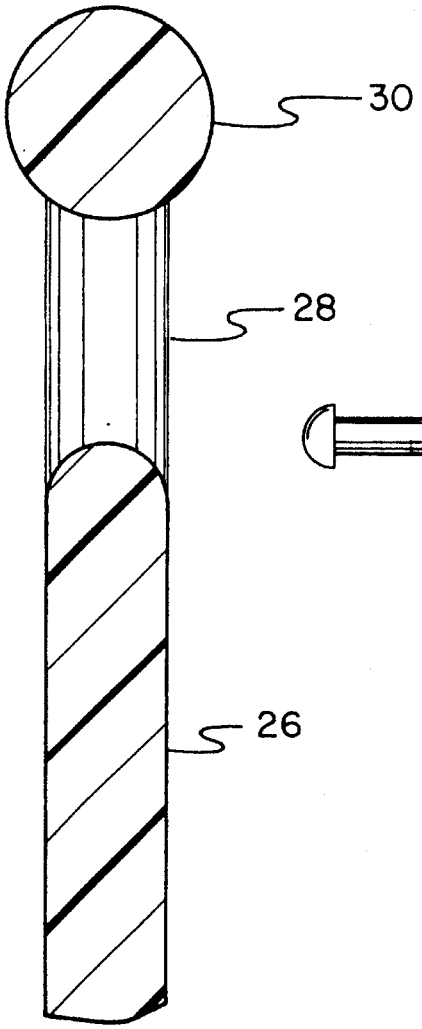
FIG. 5 is a cross sectional view taken along line 5—5 of FIG. 3.
Figure 6:
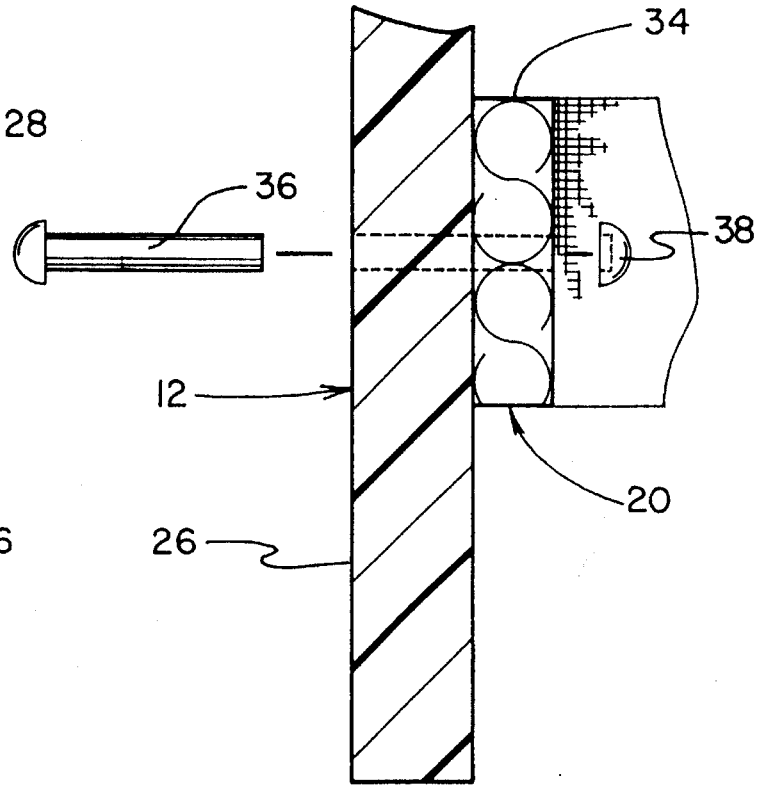
FIG. 6 is an exploded cross sectional view taken along line 6—6 of FIG. 3.

As best illustrated in FIG. 3, it can be shown that the alignment strap 18 of the present invention 10 preferably comprises a closed annular strap 32 secured at diametrically opposed portions thereof to the elongated members 26 of the handle means 12 and 16. The closed annular strap 32 is of a fixed circumference and serves merely to circumferentially extend about the beverage keg 14 to preclude pivoting of the handle means 12 and 16 relative thereto. The securing strap 20, as shown in FIG. 3, comprises an open annular strap 34 having spaced free distal ends removably coupled together by the buckle 22. The buckle 22 permits selective adjustment of at least one of the ends of the open annular strap 34 of the securing strap 20 so as to permit tightening of the securing strap 20 about the beverage keg 14 beneath the annular ridge 24 thereof. As shown for the open annular strap 34 of the securing strap 20, the straps 32 and 34 are preferably secured to the respective elongated members 26 of the handle means 12 and 16 by a rivet 36 extending therethrough which is deformed or secured to an end cap 38 by welding or the like. The rivet connection provided by the rivets 36 permits the straps 18 and 20 to be closely positioned relative to the side wall of the beverage keg 14 during use of the device 10.

Figure 7:
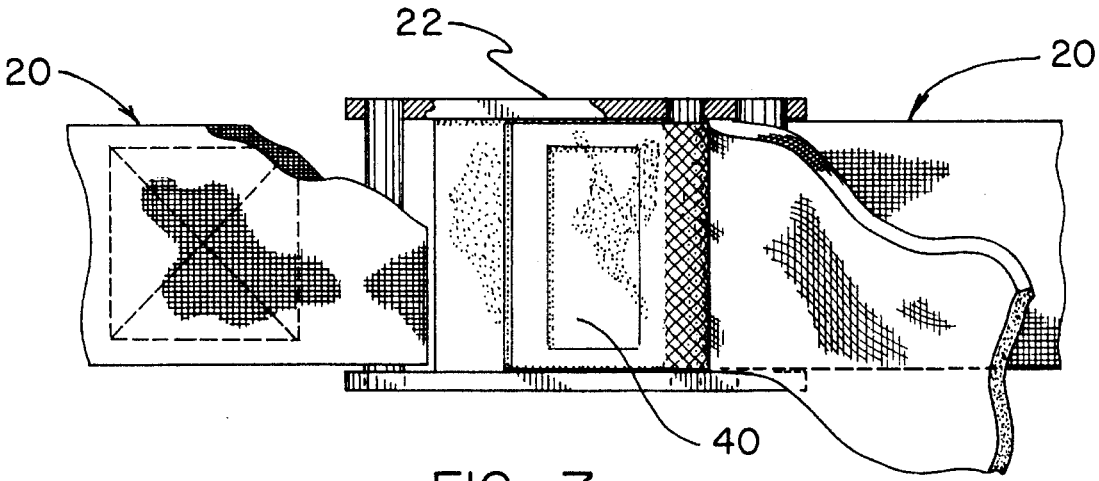
FIG. 7 is an exploded elevation view of a buckle comprising a portion of the present invention.

Referring now to FIG. 7, it can be shown that the buckle 22 comprises a perimeter frame (not labeled) having unlabeled strap axles extending in a substantially spaced and parallel orientation. A first free distal end of the open annular strap 34 is secured to a first one of the strap axles of the perimeter frame, with a locking lever 40 being pivotally mounted within the perimeter frame and positioned for pivotal positioning relative to a second one of the strap axles. By this structure, a second free distal end of the open annular strap 34 can be positioned between the second one of the strap axles and the locking lever, whereby a pivotal movement of the locking lever can then be manually accomplished so as to capture the strap 34 between the locking lever and the second one of the strap axles when positioned tightly about the beverage keg 14 and beneath the annular ridge 24 thereof.

In use, the beverage keg handling device 10 of the present invention can be easily utilized to facilitate manual manipulation of a beverage keg 14. The present invention 10 substantially eliminates a need for a prior art method of manipulating the beverage keg 14 which included grasping of opposed ends of the side wall thereof by one or more individuals.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. A beverage keg handling device comprising:

a first handle means positionable vertically along a side wall of a beverage keg for being grasped and manipulated by an individual;

a second handle means positionable vertically along a diametrically opposed portion of the side wall of the beverage keg relative to the first handle means and for being grasped and manipulated by the individual;

a securing strap of open annular configuration adapted to be positioned beneath an annular ridge of a beverage keg such that an individual can grasp the first handle means and second handle means to facilitate manual manipulation of the beverage keg; and an alignment strap of closed annular configuration extending between the first handle means and the second handle means and being spaced from the securing strap for circumferential positioning about the beverage keg.

2. The beverage keg handling device of claim 1, wherein the handle means each comprise an elongated member which can be vertically positioned along a side wall of a beverage keg, the elongated member including spaced handle projections extending therefrom; and a cylindrical handle tube extending between the spaced handle projections so as to permit an individual to extend digits of a human hand between the spaced handle projections and about the cylindrical handle tube.

3. The beverage keg handling device of claim 2, wherein the alignment strap comprises a closed annular strap secured at diametrically opposed portions thereof to the elongated members of the handle means.

4. The beverage keg handling device of claim 3, wherein the closed annular strap is of a fixed circumference.

5. The beverage keg handling device of claim 4, wherein the securing strap comprises an open annular strap having spaced free distal ends removably coupled together by a buckle.

6. The beverage keg handling device of claim 5, wherein the buckle is adapted to permit selective adjustment of at least one of the ends of the open annular strap of the securing strap relative to the buckle so as to permit tightening of the securing strap about a beverage keg.

7. A beverage keg handling device comprising:

a beverage keg having an annular ridge extending thereabout;

a first handle means positioned vertically along a side wall of a beverage keg for being grasped and manipulated by an individual;

a second handle means positioned vertically along a diametrically opposed portion of the side wall of the beverage keg relative to the first handle means and for being grasped and manipulated by the individual;

a securing strap of open annular configuration positioned beneath the annular ridge of the beverage keg such that an individual can grasp the handle means to facilitate manual manipulation of the beverage keg; and an alignment strap of closed annular configuration extending between the first handle means and the second handle means and being spaced from the securing strap, the alignment strap being circumferentially positioned about the beverage keg.

8. The beverage keg handling device of claim 7, wherein the handle means each comprise an elongated member vertically positioned along the side wall of the beverage keg, the elongated member including spaced handle projections extending therefrom; and a cylindrical handle tube extending between the spaced handle projections so as to permit an individual to extend digits of a human hand between the spaced handle projections and about the cylindrical handle tube.

9. The beverage keg handling device of claim 8, wherein the alignment strap comprises a closed annular strap secured at diametrically opposed portions thereof to the elongated members of the handle means.

10. The beverage keg handling device of claim 9, wherein the closed annular strap is of a fixed circumference.

11. The beverage keg handling device of claim 10, wherein the securing strap comprises an open annular strap having spaced free distal ends removably coupled together by a buckle.

12. The beverage keg handling device of claim 11, wherein the buckle is adapted to permit selective adjustment of at least one of the ends of the open annular strap of the securing strap relative to the buckle so as to permit tightening of the securing strap about a beverage keg.

* * * * *